United States Patent [19]

Bubley

[11] Patent Number: 4,537,126

[45] Date of Patent: Aug. 27, 1985

[54] AUTOMATIC PEEL CONTROL MECHANISM

[75] Inventor: Henry J. Bubley, Deerfield, Ill.

[73] Assignee: American Screen Printing Equipment Co., Chicago, Ill.

[21] Appl. No.: 436,679

[22] Filed: Oct. 26, 1982

[51] Int. Cl.[3] ..... B41L 13/16; B41F 15/08

[52] U.S. Cl. ..... 101/123; 101/126

[58] Field of Search ..... 101/114, 123, 126, 124

[56] References Cited

U.S. PATENT DOCUMENTS

| | | | |
|---|---|---|---|
| 2,936,705 | 5/1960 | Hall | 101/123 |
| 3,138,095 | 6/1964 | Wells | 101/126 |
| 3,263,603 | 8/1966 | Fuchs | 101/123 |
| 3,384,010 | 5/1968 | Cotterell | 101/123 |
| 3,538,846 | 8/1968 | Jaffa | 101/123 |
| 3,731,623 | 5/1973 | Bubley et al. | 101/114 |
| 3,859,917 | 1/1975 | Bubley et al. | 101/123 |
| 3,955,501 | 5/1976 | Bubley et al. | 101/123 |
| 4,193,344 | 3/1980 | Ericsson | 101/126 |
| 4,254,707 | 3/1981 | Lambert | 101/123 |
| 4,254,708 | 3/1981 | Bubley et al. | 101/123 |
| 4,267,773 | 5/1981 | Scherp | 101/123 |

FOREIGN PATENT DOCUMENTS 2005101 8/1971 Fed. Rep. of Germany ..... 101/124

*Primary Examiner*—Clyde I. Coughenour

*Attorney, Agent, or Firm*—Fitch, Even, Tabin & Flannery

[57] ABSTRACT

An automatic peel control mechanism for use in a screen printing press employs a cam-driven mechanical linkage to raise the front end of the screen frame at a controlled rate to a predetermined height above the printing bed in timed relation to the motion of the carriage which transports the squeegee. The linkage includes a pair of elongated reciprocating bars which extend the length of the printing head and are connected to lifters at their forward ends to lift the front end of the printing screen. The cam is rotatably mounted upon the carriage drive shaft. The rotation of the cam is controlled by a roller chain assembly which maintains a timed relationship between the cam and the drive shaft. The initial off contact dimension and peel rate may be readily adjusted by varying the initial position and the rate of travel of the elongated bars.

5 Claims, 5 Drawing Figures

AUTOMATIC PEEL CONTROL MECHANISM

The present invention relates generally to screen printng apparatus and more particularly to an improved peel mechanism for use in a screen printing press.

In a typical screen printing press, ink is applied to a sheet of stock by a squeegee which is separated from the sheet by a screen mounted in a screen frame. The sheet is supported from below by a generally planar, horizontal printing bed. To apply ink to a sheet of stock, the squeegee travels from the front of the screen frame to the rear of the screen frame, pressing downward on the screen and forcing ink through the screen onto the upper surface of the underlying sheet. The downward pressure of the squeegee and the properties of the ink may cause a portion of the screen immediately behind the squeegee to adhere to the underlying sheet of stock after the squeegee has passed over that portion. Excessive adherence is undesirable because the portion of the screen which remains in contact with the printed sheet may be displaced laterally due to lateral force exerted on the screen by the squeegee, resulting in smearing of the ink on the print.

To prevent such smearing, mechanisms have been developed to continuously peel the screen away from the printed sheet behind the squeegee. Peel mechanisms typically accomplish this by lifting the front end of the screen frame as the squeegee travels toward the rear. At the start of a printing stroke, the front end of the screen frame is typically spaced from the sheet by a small distance, herein referred to as the initial off contact dimension. The rate of lifting is herein referred to as the peel rate. Ideally, the lifting is timed to cooperate with the motion of the squeegee so that throughout the stroke of the squeegee the lift is of sufficient magnitude to prevent smearing but not so great that the portion of the screen which is directly beneath the squeegee at a particular time is lifted from the underlying stock while the squeegee is above it, as this would prevent application of ink to the stock. In addition, it is desirable that the lifting force applied to the front end of the screen frame be approximately equal on both sides of the frame to avoid twisting of the screen frame.

One known type of peel control mechanism employs springs to apply upward force to the front end of the screen frame and has rollers traveling along the upper surfaces of the sides of the frame as the squeegee travels to apply downward force in opposition to the springs. As the squeegee travels and the rollers move toward the rear of the frame, the spring force deflects the front of the screen frame upward to peel the screen away from the portion of the stock which has already been printed. A mechanism of this type is described in U.S. Pat. No. 4,254,708 to Bubley et al. This type of mechanism is not suitable for some press configurations.

Another known peel control mechanism employs a lever which extends above the frame from the front to the rear of the screen and which is pivoted upward by the squeegee carriage as the carriage travels through its stroke so that the front end of the lever moves upward to lift the front end of the screen. This type of peel mechanism is not suitable for presses having a long stroke because the deflection of the lever becomes too great if the lever is over approximately 40 inches in length.

A third known peel control mechanism employs a pair of cables to raise the front of the screen frame.

Cable arrangements of this type are described in U. S. Pat. No. 3,731,623 to Bubley et al., U.S. Pat. No. 3,859,917 to Bubley et al. and U.S. Pat. No. 3,955,501 to Bubley et al. The cables are difficult to adjust to vary the initial off contact dimension or the peel rate.

Accordingly, it is a general object of the present invention to provide an improved peel control mechanism which is suitable for use in long stroke presses.

Further objects and advantages of the present invention will become apparent from the following detailed description taken in connection with the accompanying drawings.

Figure 1:
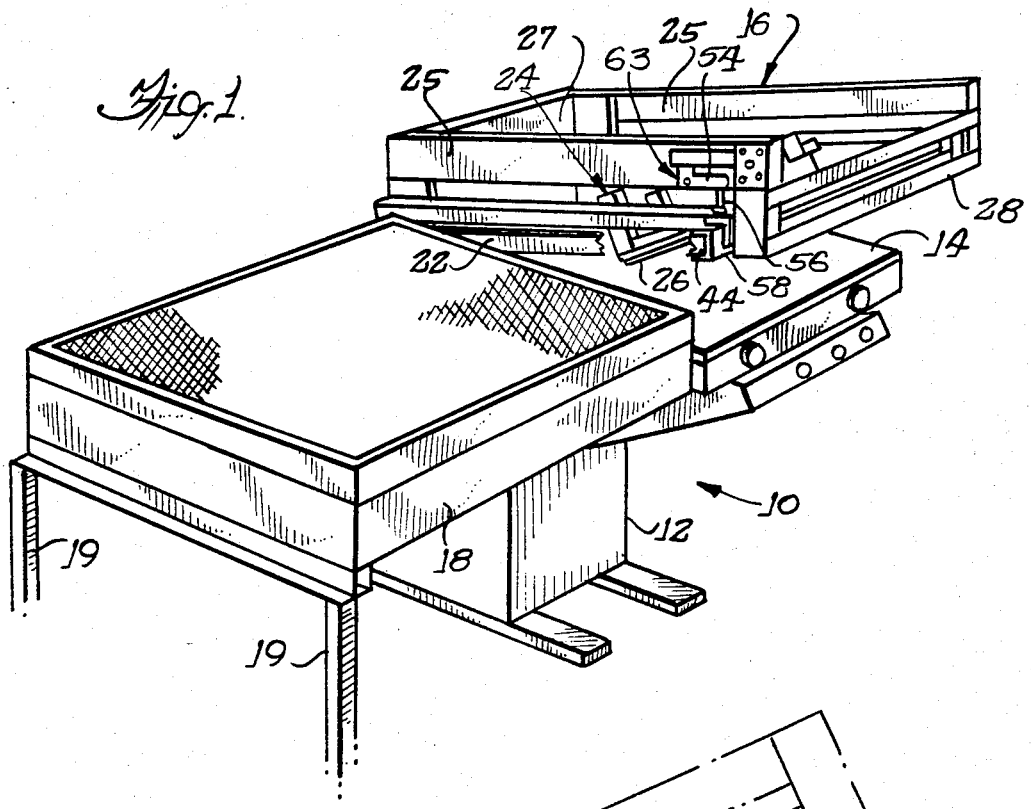
FIG. 1 is a perspective view of a press embodying the present invention.

Referring particularly to FIG. 1, the present invention is generally embodied in a screen printing press, indicated generally at 10. The press 10 includes a press frame 12 which supports a generally planar printing bed 14 and a pivoting head 16. A takeoff assembly 18 for removing printed sheets from the printing bed 14 is positioned adjacent thereto. The takeoff assembly is not a part of the press, but is used in conjunction therewith in a printing operation. One side of the takeoff assembly is attached to the press frame 12, and the other side rests on two legs 19. The pivoting head 16 supports a generally rectangular screen frame 22 and a carriage 24. A screen 23 (FIG. 2) is fastened at its edges to the screen frame and thereby held in a stretched position. The carriage transports a squeegee 26 in lateral reciprocating motion over the top of the screen 23 between the front and the rear of the screen. The carriage may also transport a flood bar (not shown) which cooperates with the squeegee during the printing cycle.

Figure 2:
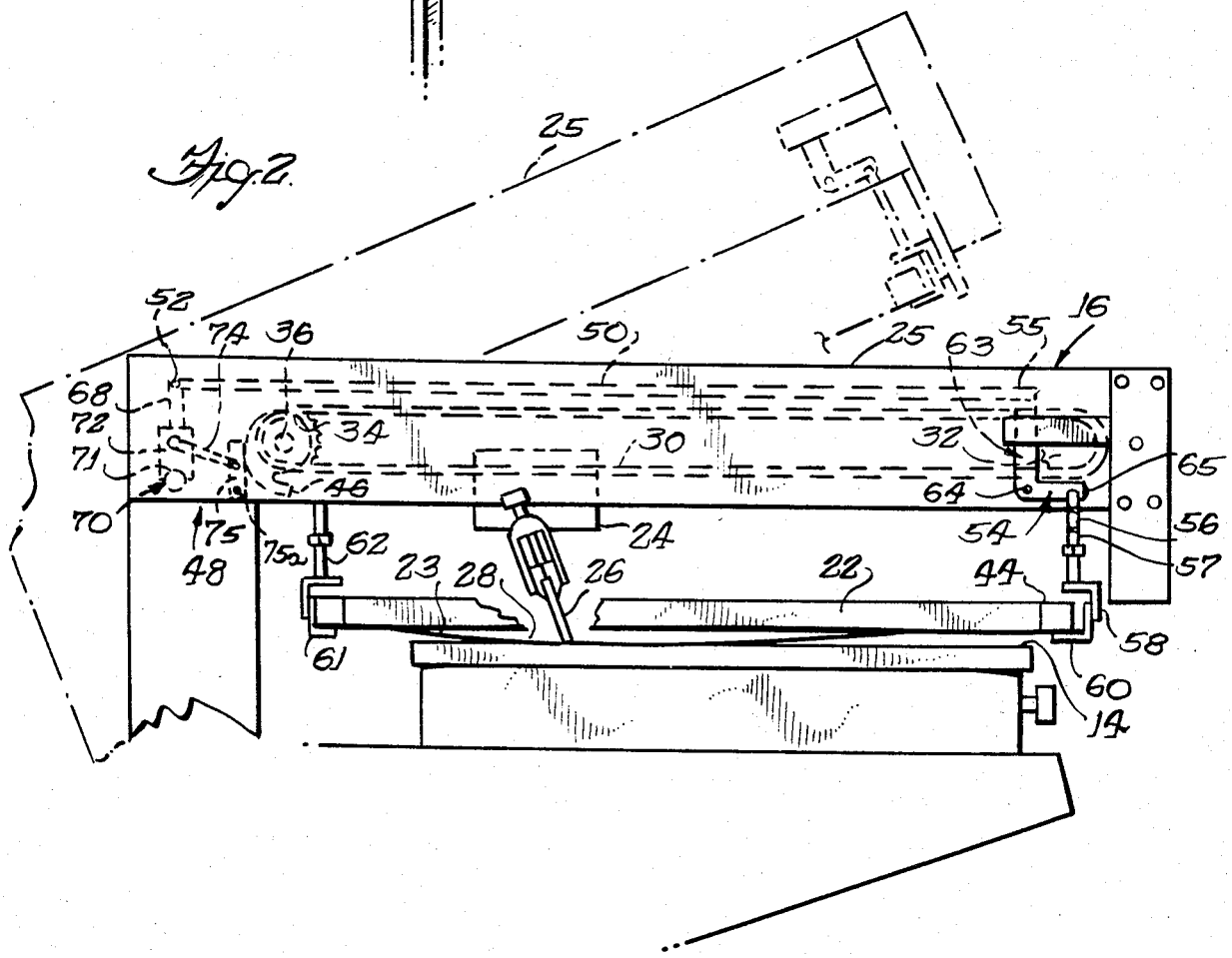
FIG. 2 is a partial side elevational view of a press embodying the present invention shown on an enlarged scale and with portions broken away, the printing head being shown in position for printing with solid lines, and being shown in an upwardly pivoted position with broken lines.

To print a sheet of stock, the head 16 is lowered to the position illustrated in FIG. 2 and the squeegee 26 is carried along the upper surface of the screen 23 from the front to the rear, forcing ink downward therethrough and onto the underlying sheet of stock. The screen frame 22 is generally spaced a small distance above the printing bed 14 at the beginning of a printing stroke so that the entire screen is not in contact with the stock. The downward pressure of the squeegee 26 brings the portion of the screen 23 directly under the squeegee into contact with the screen during the printing cycle.

Figures 3, 4, 5:
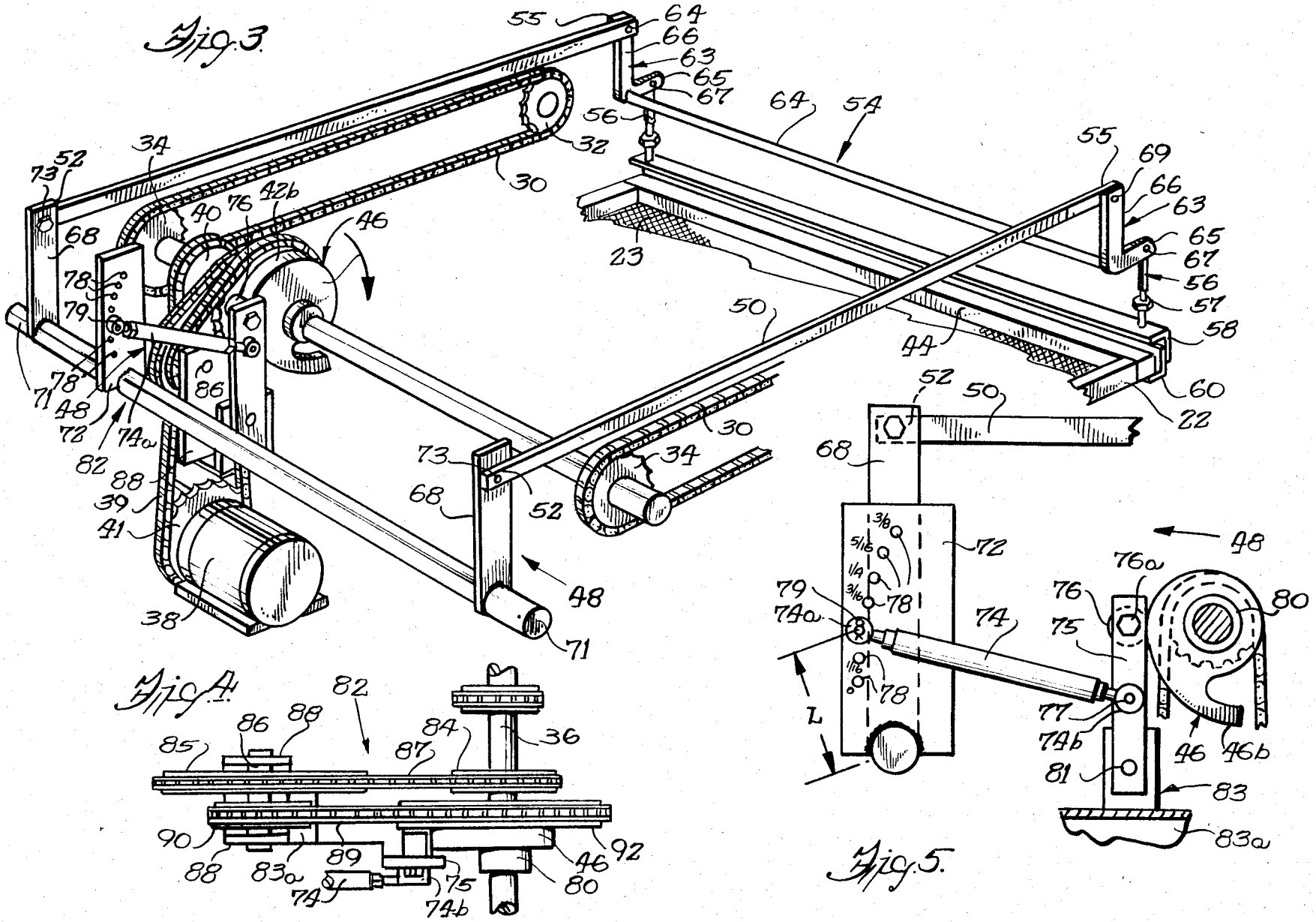
FIG. 3 is a perspective view of the peel control mechanism of the press of FIG. 1, shown on an enlarged scale and with portions broken away.
FIG. 4 is a plan view of the speed reducer of the peel control mechanism of FIG. 3, shown on an enlarged scale and with portions broken away.
FIG. 5 is a partial side elevational view of the adjustable lever mechanism of FIG. 3, shown on an enlarged scale partially in section, and with portions broken away.

As best seen in FIG. 1, the carriage 24 and squeegee 26 extend transversely across the width of the printing head 16 between a pair of side frames 25 extending fore and aft. These side frames 25 are joined at their rearward ends to a rear transverse side frame 27 and at their forward ends to a front transverse side frame 28 to form a rectangular printing head frame. A motor driven carriage drive employs two roller chains 30 connected to opposite ends of the carriage 24 to transport the carriage and squeegee between the front and rear of the printing head. Each roller chain is supported on front and rear sprockets 32 and 34. As best seen in FIG. 3, the rear sprockets 34 are rigidly mounted upon a transverse drive shaft 36 which extends across the width of the printing head. The drive shaft 36 is driven by an electric motor 38 through a drive chain 39 which engages sprockets 40 and 41 fixed to the drive shaft and the motor shaft respectively.

As the carriage 24 travels the length of the printing bed 14, smearing of the print may result from adherence of portions of the screen to the printed surface immediately behind the squeegee 26 and subsequent lateral displacement of these portions due to friction between the squeegee 26 and the screen 23. Such smearing may be prevented by raising the front end 44 of the screen frame 22 to continuously peel the screen upward and away from the printed surface behind the squeegee 26 as it travels. Mechanisms heretofore employed for accomplishing this have not been satisfactory for use in long stroke presses.

In accordance with the present invention, a compact, precise and inexpensive automatic peel control mechanism is provided which employs a simple mechanical linkage driven by a cam 46 to raise the front end 44 of the screen frame at a controlled rate to a predetermined height above the printing bed 14 in timed relation to the motion of the squeegee 26 and carriage 24. A lever mechanism, indicated generally at 48, driven by the cam 46 imparts longitudinal reciprocating motion to a pair of elongated bars 50 which extend along opposite sides of the printing head 16 and which are connected to the lever mechanism 48 at their rear ends 52 and connected to a lifter 54 at their front ends 55. The lifter 54 translates the longitudinal motion of the bars into upward and downward motion of links 56 connecting the lifter to the front end 44 of the screen frame 22. The elongated bars 50 are placed in tension so that elastic deformation of the bars during operation is relatively small as compared with that of known systems which employed long levers or bars loaded at their front ends which deflected substantially during operation. The present invention provides an easy manner of varying the initial position and the rate of travel of the elongated bars 50 to vary initial off contact dimension and the peel rate. To maintain a timed relationship between the motion of the peel mechanism and the motion of the squeegee 26, the rotation of the cam 46 is controlled by a direct mechanical connection to the drive shaft 36.

Turning now to a more detailed description of a preferred embodiment of the present invention, the front end 44 of the screen frame 22 is supported by a generally channel shaped front support member 58 which has one side 60 extending beneath the front end of the frame along the width of the frame. A rear support member 61 (FIG. 2) supports the rear end of the frame. The rear support member is similar in shape to the front support member and is suspended from the printing head by a pair of vertical supports 62. The front support member is connected to the lifter by the links 56.

The preferred links 56 are in the form of turnbuckles 57 which are adjustable in length so that the screen printing frame may be adjusted vertically relative to the printing head 16. The lifter, as best seen in FIGS. 2 and 4, includes a pair of bell cranks 63 which are fixedly joined to opposite ends of a horizontal shaft 64 which is journaled through bearings in the side frames so as to be rotatable about its longitudinal axis. The bell cranks are fixed to the shaft at the juncture of a horizontal leg 65 and a vertical leg 66 on each bell crank. The horizontal leg of each bell crank 63 extends above the upper end of one of the links 56 and is connected thereto by a pin connection 67 to the upper end of a link 56. The vertical bell crank legs 66 are connected by pivot pins 69 to the forward ends of the elongated bars 50, which extend along, and may be hidden within, the side frames 25 of the printing head 16. The longitudinal pulling of the bars 50 rearwardly pivots the bell cranks and lifts the links 56 and the front end 44 of the screen frame 22.

The elongated bars 50 are shifted by the cam means 46 and to this end are joined by pivotal connections 73 at their rearward ends 52 to a pair of upstanding crank arms 68 which are driven by the cam means. The crank arms have lower ends rigidly attached to the opposite ends of a horizontal shaft 70 having its ends 71 journaled in the side frames 25 of the printing head 16 near the rearward ends of the side frames, as shown in FIG. 2. The crank arms 68 and the shaft 70 turn about the longitudinal axis of the shaft 70 when driven by a driving means which includes a drive plate 72 fixedly secured at its lower end to the shaft 70 and a drive rod 74 extending between a cam follower lever 75 and the drive plate 72.

A series of apertures 78 are formed in the plate 72, and a detachable pin 79 inserted into one of the apertures 78 connects one end **74*a* of the drive rod to the drive plate. The other end 74*b* of the drive rod is connected by a pin 77 to the upper end of the cam follower lever 75. As best seen in FIG. 5, the cam follower lever 75 is mounted for pivotal movement at its lower end by a pivot pin 81 which is mounted in a stationary bracket 83 fixed to a horizontal member 83*a* of the printing head 16. At the upper end of the cam follower lever 75 is a roller cam follower 76 rotatably mounted on a stud 76*a* carried by the cam follower lever 75. As the cam rotates in a clockwise direction as indicated in FIG. 3, the cam follower 76 rolls along a cam surface 46*b* of the cam 46** which herein has the shape of a scroll or spiral.

Referring particularly to FIG. 5, the peel rate and the initial off contact dimension may be varied by changing the point at which the drive rod 74 is attached to the drive plate 72. This may be accomplished simply by removing the pin 79 to detach the rod 74 from the drive plate 72 and reattaching the rod at a different aperture 78.

The initial off contact dimension is determined by the degree of angular displacement of the shaft 70 required to align a desired aperture with the end **74*a* of the drive rod 74 at the beginning of a cycle. The apertures 78 are positioned so that, proceeding from the bottom aperture to the top aperture, the distances between each of the apertures 78 and the pin 77 progressively decrease when the lever 75 is in its starting position. Thus, when the drive rod 74 is disconnected from the aperture to which it is pinned and connected to one of the the apertures above it, a slight counterclockwise rotation of the shaft 70 is necessary to align the end 74*a* of the rod 74 with the latter aperture. If the drive rod 74 is disconnected and reattached to a lower aperature, a slight clockwise rotation is required. A counterclockwise rotation of the shaft 70** increases the initial off contact dimension, and a clockwise rotation decreases it.

Herein, it is preferred that indicia be provided on the drive plate 72 adjacent each of the apertures to indicate the initial off contact dimension. For example, as illustrated in FIG. 5, indicia may be provided for each aperture 78 so that a person making an adjustment can easily increase or decrease the peel rate by 1/16 inch increments by moving between the apertures designated $\frac{3}{8}$, 5/16, $\frac{1}{4}$, etc.

The peel rate and the distance by which the front end of the screen is raised during a printing stroke are inversely related to the distance "L" between the point at which the rod 74 is attached to the plate 72 and the axis of the horizontal rod 70. The placement of the apertures 78 on the drive plate 72 is such that the initial off contact dimension increases as the distance L increases. Thus, the peel rate and distance are inversely related to the initial off contact dimension.

Referring now to FIG. 4, the scroll cam 46 is fixed to a sleeve 80 which is rotatably and coaxially mounted upon the drive shaft 36 so that the scroll cam 46 and drive shaft 36 may rotate at different speeds. The timed relationship between the cam 46 and the drive shaft 36 is provided by a speed reducer, indicated generally at 82, which maintains a predetermined ratio between the angular velocity of the drive shaft 36 and that of the scroll cam 46. As best illustrated in FIG. 4, the speed reducer 82 includes a small-diameter sprocket 84 fixed to the drive shaft which drives a large-diameter sprocket 85 fixed to a driven shaft 86 through a roller chain 87. The driven shaft is journaled at its opposite ends through support plates 88 which are fixed to the horizontal member 83*a*. A small-diameter sprocket 90 fixed to the driven shaft 86 engages a roller chain 89 to drive a large-diameter sprocket 92 fixed to the sleeve 80 to which the cam 46 is fixed. Thus, the speed reducer rotates the cam at an angular velocity less than that of the drive shaft 36 and directly proportional thereto. The timed relationship provides precise repetition of the peel motion relative to the carriage motion during successive cycles. While roller chains and sprockets are employed to construct the speed reducer in the illustrated embodiment, it will be appreciated that a gear system or equivalent could alternatively be employed to maintain the timing.

From the foregoing, it will be seen that the peel control mechanism in accordance with the present invention provides a relatively inflexible mechanical linkage between the carriage drive and the front of the screen frame so that a precise timed relation is maintained between the squeegee motion and the peel motion. The use of elongated bars loaded in tension to transmit lifting force from the lever mechanism to the lifter enables the present invention to be utilized with either long stroke or short stroke presses. The adjustable rate and dimension of peel make the present invention adaptable to various printing conditions.

While a preferred embodiment has been shown and described, it will be understood that there is no intent to limit the invention by such disclosure. The invention includes all modifications and alternate constructions falling within the spirit and scope of the invention as defined in the appended claims.

What is claimed is:

1. In a screen printing press, the combination of:
a press frame,
a screen,
a screen frame supporting the screen,
a printing bed fixed to the press frame for supporting the screen frame and a sheet of stock during printing,
a squeegee which slides across an upper surface of the screen during printing,
a traveling carriage which transports the squeegee in reciprocating motion between a front end and a rear end of the screen during a printing cycle,
carriage driving means for imparting the reciprocating motion to the carriage,
a printing head mounted on the press frame to support the carriage and screen frame, and
an automatic peel control mechanism which raises a front end of the screen frame at a controlled rate during a printing cycle, the automatic peel control mechanism comprising:
a rotatable cam means,
means for rotating the cam means in timed relation to the travel of the carriage, extending means extending from the cam means to the front end of the screen frame and extending along the sides of the printing head,
lever means driven by said cam means to operate said extending means to lift the front end of the screen, and
adjusting means associated with said lever means to change simultaneously an initial off contact position for the screen and a rate of peel for the screen.

2. In a screen printing press, the combination of:
a press frame,
a screen,
a screen frame supporting the screen,
a printing bed fixed to the press frame for supporting the screen frame and a sheet of stock during printing,
a squeegee which slides across an upper surface of the screen during printing,
a traveling carriage which transports the squeegee in reciprocating motion between a front end and a rear end of the screen during a printing cycle,
carriage driving means for imparting the reciprocating motion to the carriage,
a pivoted printing head having a rearward end pivotally mounted on the press frame to support the carriage and screen frame relative to the press frame, and
an automatic peel control mechanism which raises a front end of the screen frame at a controlled rate during a printing cycle, the automatic peel control mechanism comprising:
a rotatable cam means located at the rearward end of the printing head,
means for rotating the cam means in timed relation to the travel of the carriage, and
a mechanical linkage extending from the cam means at the rearward end of the printing head to the front end of the screen frame including elongated, reciprocating rigid members extending along the sides of the printing head and being pushed and pulled by said cam means, and lifters at the forward ends of the elongated members, rotation of the cam moving the linkage to lift the front end of the screen frame,
said cam means comprising a scroll cam having a spirally configured peripheral camming surface,
said mechanical linkage further comprising a lever mechanism positioned near the rear of the printing head to be driven by the cam means, the rigid members being connected at their rearward ends to the lever mechanism so that the lever mechanism applies longitudinal force to them, the lifters including bell cranks to translate the longitudinal movement of the rigid members into the upward movement of the front end of the screen, said lever mechanism including means for varying both the initial off contact position and the rate at which the front end of the screen is raised relative to the rate at which the carriage travels.

3. A combination in accordance with claim 2 wherein the lever mechanism includes means for adjusting the distance that the front end of the screen is raised at the beginning of a printing cycle.

4. A combination in accordance with claim 2 wherein the carriage driving means includes two looped roller chains extending along opposite sides of the printing head, front and rear sprockets for supporting each chain, a rotating drive shaft extending across the rear of the printing head rigidly supporting the rear sprockets and imparting rotation thereto, an electric motor, and transmission means to transmit power from the motor to the drive shaft.

5. A combination in accordance with claim 4 wherein the scroll cam is rotatably mounted upon the drive shaft.

* * * * *